US009482482B1

(12) United States Patent
Sanders

(10) Patent No.: US 9,482,482 B1
(45) Date of Patent: Nov. 1, 2016

(54) SAFE AND SECURE FIREARM MOUNT

(71) Applicant: William T. Sanders, Galloway, OH (US)

(72) Inventor: William T. Sanders, Galloway, OH (US)

( * ) Notice: Subject to any disclaimer, the term of this patent is extended or adjusted under 35 U.S.C. 154(b) by 0 days.

(21) Appl. No.: 14/737,728

(22) Filed: Jun. 12, 2015

(51) Int. Cl.

| | |
|---|---|
| ***F41A 17/00*** | (2006.01) |
| ***F41A 17/46*** | (2006.01) |
| ***E05B 73/00*** | (2006.01) |
| ***F41A 35/00*** | (2006.01) |
| ***A47B 81/00*** | (2006.01) |
| ***F41A 17/02*** | (2006.01) |

(52) U.S. Cl.
CPC ..... *F41A 17/46* (2013.01); *A47B 81/005* (2013.01); *E05B 73/00* (2013.01); *F41A 17/02* (2013.01); *F41A 35/00* (2013.01)

(58) Field of Classification Search
CPC .. E05B 73/00; E05B 73/007; E05B 73/0082; E05B 73/0094; A47B 81/00; A47B 81/005; F41A 17/00; F41A 17/02; F41A 17/04; F41A 17/46
See application file for complete search history.

(56) References Cited

U.S. PATENT DOCUMENTS

| | | | | | |
|---|---|---|---|---|---|
| 1,513,267 | A * | 10/1924 | Parks | F41A 17/02 | 42/70.11 |
| 4,139,100 | A * | 2/1979 | Reed | F41A 17/02 | 211/4 |
| 5,138,786 | A * | 8/1992 | Fischer | E05B 73/00 | 211/64 |
| 5,287,972 | A * | 2/1994 | Saathoff | A47B 81/005 | 211/4 |
| 5,621,996 | A * | 4/1997 | Mowl, Jr. | F41A 23/18 | 211/64 |
| 5,720,193 | A * | 2/1998 | Dick | E05B 37/00 | 211/64 |
| 6,536,151 | B1 * | 3/2003 | Ketterer | A47B 81/005 | 42/70.11 |
| 7,478,724 | B2 * | 1/2009 | Vor Keller | F41A 17/02 | 206/317 |
| 9,010,007 | B2 * | 4/2015 | Chandler | F41A 17/04 | 206/315.11 |
| 2012/0005935 | A1 * | 1/2012 | Chandler | F41A 17/04 | 42/70.11 |

* cited by examiner

*Primary Examiner* — Christopher Boswell
(74) *Attorney, Agent, or Firm* — Bryce D. Miracle; Miracle IP

(57) ABSTRACT

An apparatus for mounting and locking on a wall a firearm such as a rifle or shotgun comprising a housing assembly for supporting a firearm, a trigger and receiver guard assembly for preventing access to the trigger and receiver of the firearm, and a means for pinning the trigger and receiver guard assembly and firearm within the housing assembly while in a locked position.

11 Claims, 4 Drawing Sheets

SAFE AND SECURE FIREARM MOUNT

BACKGROUND

The present invention relates to firearms and more particularly to a wall mountable safety device for use with rifles and shotguns.

Many people own firearms including rifles, shotguns, and pistols for recreational and security purposes. These firearms are typically stored in the home environment and so there is a problem with limiting access to them, particularly having minors in the home. The owner of such a firearm is or should be concerned that such a weapon not be handled by a person not properly trained or not having permission of the owner to do so. The consequences of unauthorized and improper use of firearms are well known. Children can mishandle them possibly shooting themselves or someone else. Firearms can be misused during a stressful situation or during an argument. Moreover, theft of firearms can also be an issue if the firearms are not safely secured in a safe or other containment.

Many devices have been developed and are in use for wall mounting and safeguarding firearms. Many firearm owners do safely and properly store their firearms within guns safes, cabinets and varying gun mounts that secure the firearms preventing improper use or theft thereof. However, at the same time, it may be critical that the owner of the firearm have readily accessible access to these firearms in cases of home-defense and other emergencies. The ones available for use with rifles and shotguns have a number of shortcomings relating to ease and speediness of use, cost, and the ability to withstand attempts to defeat the security aspects of the devices.

The present invention provides an apparatus for reducing these problems. The difficulties inherent in the art are therefore overcome in a way which is simple, user friendly, and efficient—which will provide better and more advantageous results.

SUMMARY

For the foregoing reasons, what is needed is to provide a safe and secure firearm mount that securely attaches a firearm to a flat surface or wall while simultaneously prohibiting unauthorized access thereto. Moreover, the invention provides the ability for authorized persons to have the ability to quickly disengage the firearm from the firearm mount, particularly under exigent circumstances.

In a version of the invention, a firearm mount is provided which comprises a housing assembly for supporting a firearm, a trigger and receiver guard for preventing access to the firearm trigger and receiver, and a means for pinning the trigger and receiver guard assembly and firearm within the housing assembly while in a locked position.

Preferably, the housing assembly comprises a rear wall, a pair of side walls extending forward in parallel from the rear wall, the side walls each having an upper edge and at least one pair of laterally spaced engagement slots, and a means for attaching housing assembly to the wall.

Preferably, the trigger and receiver guard for preventing access to the firearm trigger and receiver is mounted between the pair of side walls forward of the firearm trigger and receiver which comprises an upper member positioned adjacent to the firearm receiver, a forward extending trigger encasement extending below the upper member positioned adjacent to the trigger and trigger guard of the firearm, and a means for preventing downward movement within the housing assembly of the trigger guard assembly.

Preferably, the means for pinning the trigger guard assembly and firearm within the housing assembly while in a locked position simultaneously cooperates with the pair of laterally spaced engagement slots while engaging forward of the upper member of the trigger and receiver guard and above the forward extending trigger encasement of the trigger and receiver guard. Thus, pinning the trigger and receiver guard in position while simultaneously urging the upper member of the trigger and receiver guard towards the firearm receiver, entrapping the receiver of the firearm within the housing.

Still other versions, benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
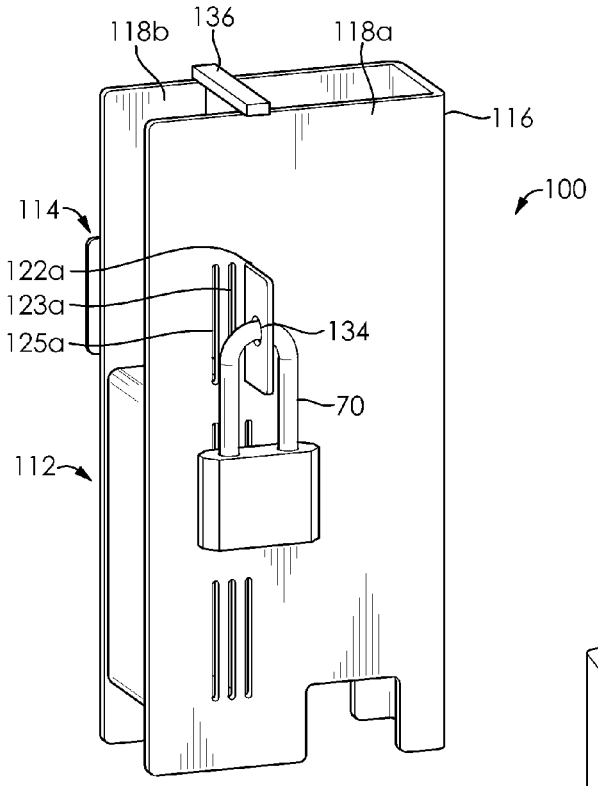
FIG. 1 is a right side perspective view of a version of the present invention.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

With reference now to the drawings, and in particular to FIG. 1-FIG. 5 thereof, a new firearm safe mount for securing and locking a firearm 50 to a wall 60 embodying the principles and concepts of the present invention and generally designated by the reference numeral 100 will be disclosed.

The firearm safe mount 100 generally comprises a housing assembly 110, a trigger and receiver guard assembly 112, and a means for pinning 114.

Figure 4:
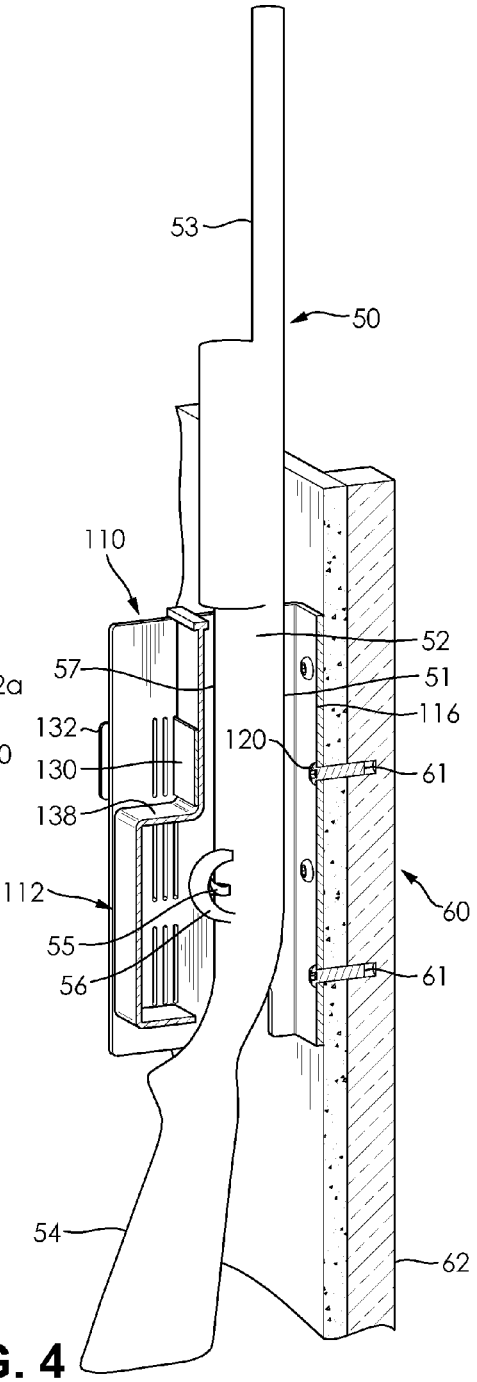
FIG. 4 is a cross sectional view of the version shown in FIG. 1 attached to a wall.
Figure 5:
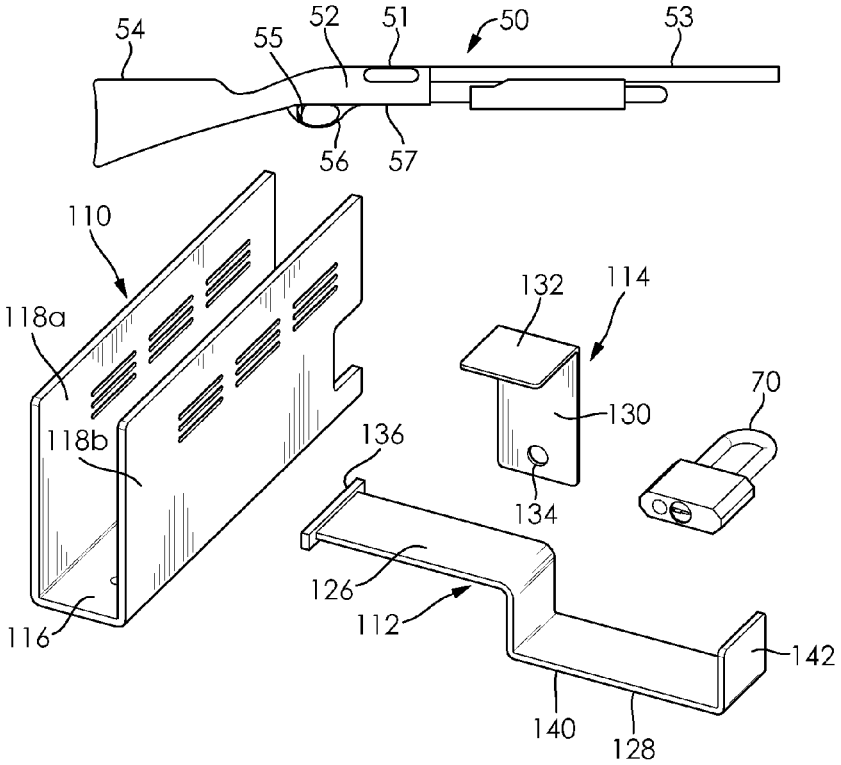
FIG. 5 is an unassembled view of the version shown in FIG. 1.

The housing assembly 110 is U-shaped comprising a rear wall 116 and a pair of mirrored sidewalls 118*a* and 118*b* extending forward in parallel from the rear wall 116. As best illustrated by FIG. 4, the housing assembly 110 is open at the top and bottom, and provides a forward facing opening to permit firearm 50 to be easily seated with the top portion 51 of the receiver 52 inserted towards and abutting the rear wall 116, with the barrel 53 extending upward and the stock 54 extending downward towards the floor or other flat surface. In this configuration, the trigger 55, the trigger guard 56 and bottom portion 57 of the receiver 52 face forward contained within the housing assembly 110.

The pair of side walls 118*a* and 118*b* comprise at least one pair of laterally spaced engagement slots 122*a* and 122*b*. In the illustrated version, there is more than one pair or, in particular, three pair of laterally spaced engagement slots 123*a* and 123*b*, 125*a* and 125*b* aligned horizontally across the upper portion of the corresponding pair of side walls 118*a* and 118*b*. The means for pinning 114 is configured to cooperate with the at least one pair of laterally spaced engagement slots 122*a* and 122*b*. In the version, the means for pinning 114 having a correspondingly fitting generally flat engagement member 130 with an angled portion forming a stopping tab 132. The flat engagement member 130 having a locking port 134 on the opposing end for engaging a locking means 70. Typically, a locking means 70 which can be quickly disengaged is desirable such as a Master Lock Speed Dial Lock or other combination lock. The means for pinning 114 is configured to insert the flat engagement member 130 through a first wall of the housing assembly 110 via an engagement slot linking the opposing wall via the corresponding engagement slot, wherein the flat engagement member 130 extends beyond the exterior of the opposing wall exposing the locking port 134 and is stopped by the stopping tab 132. It will be known that other correspondingly shaped configurations may be utilized in order to carry out the invention.

The illustrated version provides alternative pairs of laterally spaced engagement slots 122*a* and 122*b* with varying distances from the rear wall 116 which enables the housing assembly 110 to fit varying depths of firearms and receivers.

Figure 2:
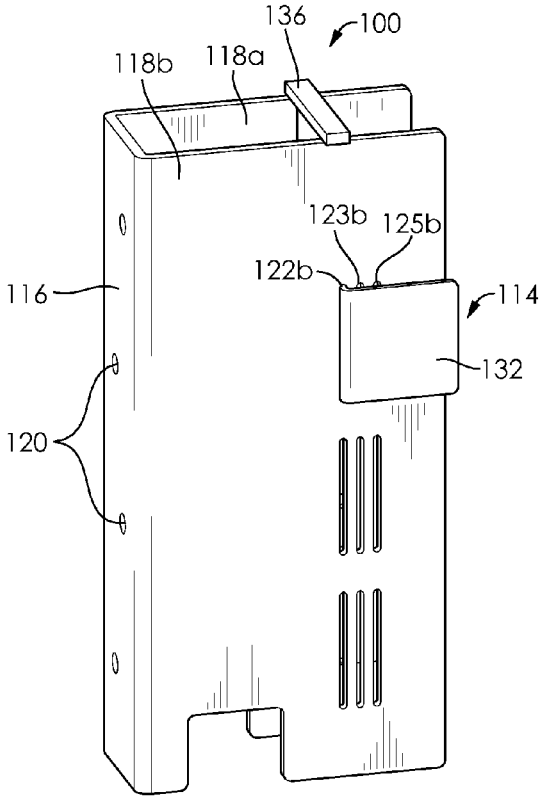
FIG. 2 is a left side perspective view of the version shown in FIG. 1.

As best illustrated by FIG. 2 and FIG. 4, the housing assembly 110 is provided with a means for attaching the housing assembly 110 to the wall 60 or as depicted in the version a plurality of openings 120 in the rear wall 116. In the version, the plurality of holes 120 accommodate fasteners or screws 61 for mounting on wall 60. Ideally, screws are utilized to attach the housing assembly 110 by passing through the plurality of holes 120, through the adjacent drywall 60 and securing into the stud 62 extending vertically therebehind or other structural member as is known in the art. It will be known the fire safe mount 100 and housing assembly 110 can be mounted either vertically, horizontally or in any configuration that carries out proper use of the invention. Ideally, the housing assembly 110 will be attached to a flat surface which provides rigidity and foundation for the fire safe mount 100.

Figure 3:
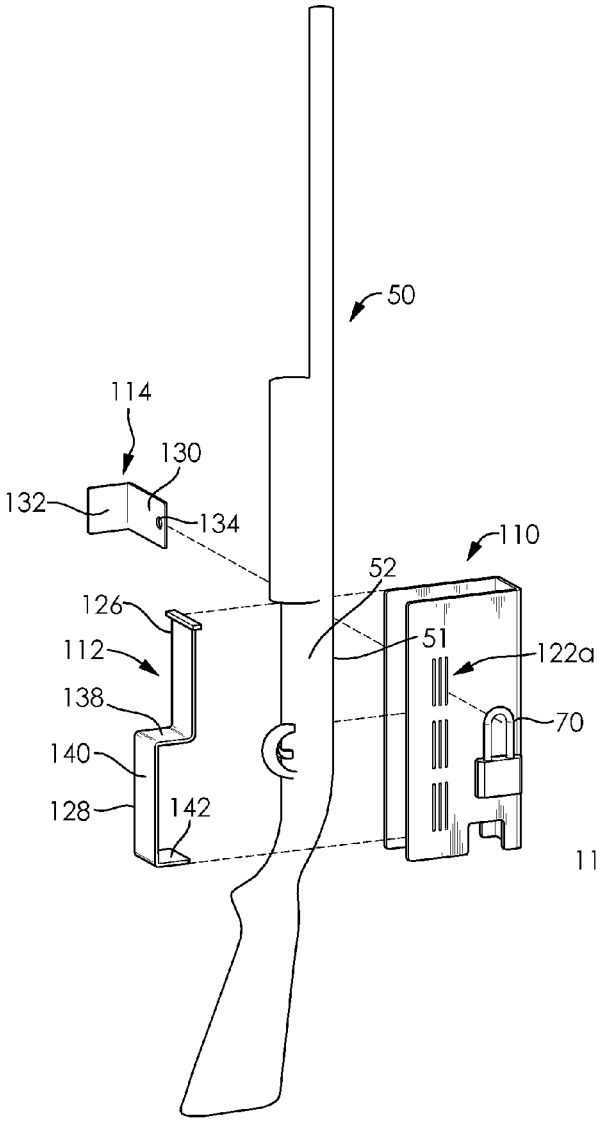
FIG. 3 is an unassembled perspective view of the version shown in FIG. 1.

Referring to FIG. 3 and FIG. 4, the trigger and receiver guard assembly 112 is generally an elongated member which is configured to snuggly fit when mounted between the pair of side walls 118*a* and 118*b* forward of the firearm trigger 55 and receiver 52 in order to prevent access to the firearm trigger 55, trigger guard 56 and the bottom portion 57 of the receiver 52, while simultaneously in conjunction with the means for pinning 114 securing the firearm 50 within the housing assembly 110. In the illustrated version, the trigger and receiver guard 112 comprises an upper member 126 extending downward forming a forward extending trigger encasement 128. The forward extending trigger encasement 128 provides space for the firearm trigger 55 and trigger guard 56 while in the assembled position.

In the version, the upper member 126 is configured in the shape of a lateral wall extending downward running parallel to and abutting the flat bottom portion 57 of the receiver 52 of the firearm 50 while in the assembled position.

The trigger and receiver guard 112 further includes a means for preventing downward movement or as illustrated in the version—outwardly extending tabs 136 located near the top end of the upper member 126, wherein while in the assembled position, the tabs 136 overhang the upper edges of the pair of side walls 118*a* and 118*b*, allowing the trigger guard assembly to hang freely therebetween inhibiting downward movement of the trigger and receiver guard 112.

In the version, (See FIG. 3) the forward extending trigger encasement 128 is U-shaped in section comprising an upward surface 138 folded downward forming a forward surface 140 and then folded backwards forming a downward surface 142. Collectively, the upward surface 138, the forward surface 140, and the downward surface 142 form the forward extending trigger encasement 128.

The firearm safe mount 100 has an unassembled position (FIG. 3) and an assembled locked position (FIG. 4) for securing the firearm safely to the wall 60. During assembly, the firearm 50 is positioned to extend through the housing assembly 110 positioning the trigger 55, the trigger guard 56, and the receiver 52 therein. Positioning may be adjusted by mounting the housing assembly 110 at a predetermined height above a surface in order to properly adapt to firearm varying sizes and dimensions. Once the firearm 50 is properly positioned within the housing assembly 110, the trigger and receiver guard assembly 112 is positioned upright between the pair of side walls 118*a* and 118*b* within the housing assembly 110 adjacent the firearm. In particular, the upper member 126 of the trigger and receiver guard assembly 112 is positioned parallel and abutting to the firearm receiver upward of the trigger 55 and trigger guard 56 with the outwardly extending tabs 136 overlapping the top edges of the pair of side walls 118*a* and 118*b*, thereby preventing downward movement of the trigger and receiver guard assembly 112. The forward extending trigger encasement 128 is positioned adjacent to the trigger 55 and trigger guard 56 forming a protective encasement thereof. Once the trigger and receiver guard assembly 112 is in proper position, the means for pinning 114 is inserted through one of the laterally spaced engagement slots traversing from one wall to the other while pinning the upper member 126 of the trigger and receiver guard assembly 112 against the firearm receiver. Thereby, pressing the receiver 52 of the firearm 50 against the rear wall 116 and the upper member 126.

After the trigger and receiver guard assembly 112 and the means for pinning 114 are in place, a locking means 70 is engaged with the locking port 134 for locking the means for pinning 114 in position. Thus, simultaneously while in the assembled locked position, the means for pinning 114, the configuration of the trigger and receiver guard assembly 112, and the physical structure of the firearm 50 prevent the trigger and receiver guard assembly 112 from moving, securely locking and containing the firearm 50 within the housing assembly 110. In particular, inward movement is prevented by the presence of the firearm 50 and receiver 52, outward movement is prevented by the means for pinning 114 applying a force to the upper member 126, upward movement is prevented by the means for pinning 114 applying a force to the upward surface 138 of the forward extending trigger encasement 128, and downward movement is prevented by the outwardly extending tabs 136 overlapping the top edges of the pair of side walls 118*a* and 118*b*.

Conversely, the firearm safe mount 100 can easily be unlocked and unassembled in a quick and safe manner for an authorized user. Firstly, the locking means 70 is unlocked and removed from the means for pinning 114 locking port 134. Thereafter, the means for pinning 114 is removed from the housing assembly 110. Finally, the firearm 50 is simply removed from the housing assembly, allowing the trigger and receiver guard assembly 112 to fall freely to the ground.

Figure 6:
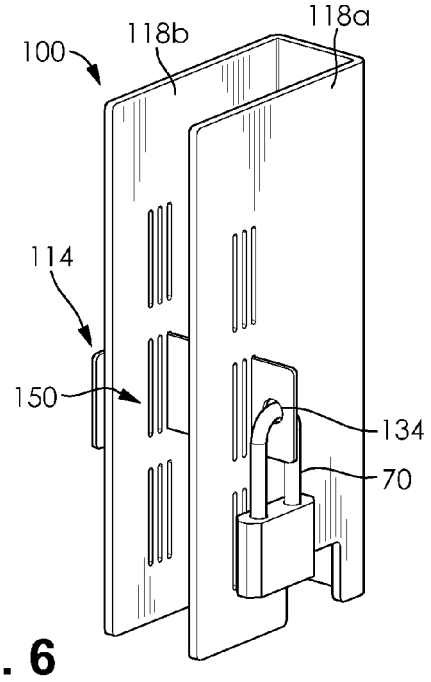
FIG. 6 is an assembled view showing use of the invention without the trigger and receiver guard assembly for use with irregular shaped firearms.

In an alternative configuration as illustrated in FIG. 6, the firearm safe mount 100 does not utilize the trigger and receiver guard assembly 112 which provides the ability to receive and fit irregular shaped firearms. Thus, the firearm 50 is positioned—as described above—within the housing assembly 110. The means for pinning 114 is inserted through one pair of laterally spaced engagement slots 150 centrally located within the housing assembly 110 traversing between the pair of mirrored side walls 118*a* and 118*b*, thereby entrapping the firearm 50 within the housing assembly 110. The means for pinning 114 locked into position by the locking means 70.

Figure 7:
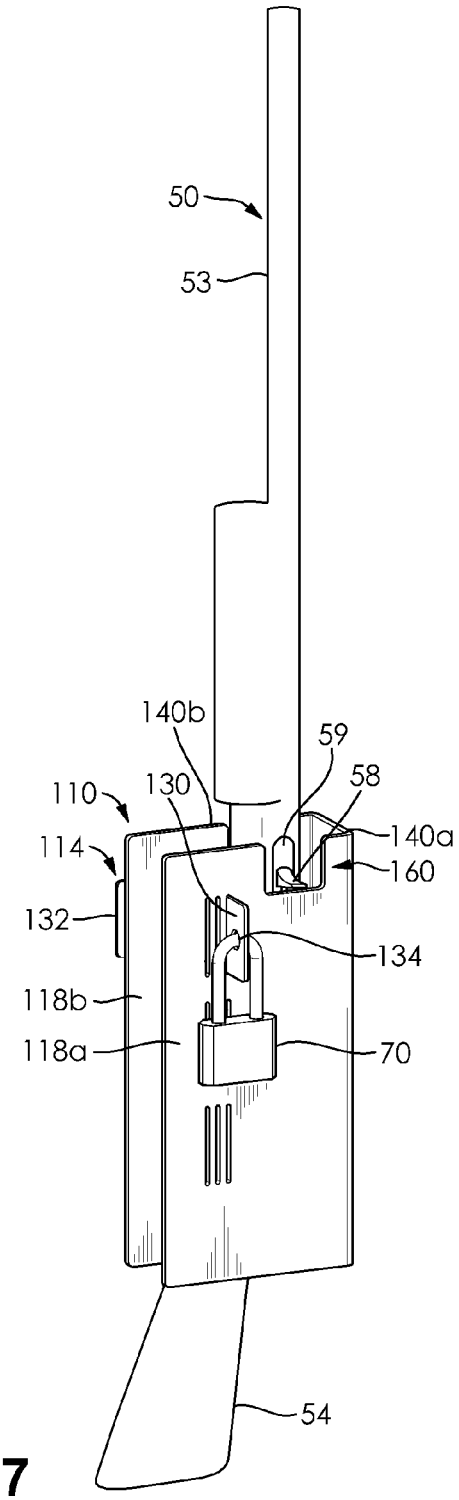
FIG. 7. is an illustrative assembled view of the version shown in FIG. 1 showing use with a semi-auto firearm.

In yet another version of the invention as illustrated by FIG. 7, the housing assembly may further comprise one or more upper gaps 160. The upper gaps 160 are configured to accommodate space for an outwardly extending operating handle 58 of the firearm bolt 59. This ensures proper fitting of the firearm 50 within the housing assembly 110. In the version the upper gaps 160 are positioned within the pair of side walls 118*a* and 118*b* opening upwards towards top edges 140*a* and 140*b*. Thereby, accommodating either a right handed or left handed semi-auto firearm having a bolt 59 with operating handle 58.

The present invention can be made in any manner and of any material chosen with sound engineering judgment. Preferably, materials will be strong, lightweight, long lasting, economic, and ergonomic such as any metals that provide support and strength to resist tampering. More preferably, the housing assembly is constructed from a single sheet of heavy gauge steel as well as other parts.

The previously described versions of the present invention have many advantages, including providing a protective device useful with firearms, while simultaneously providing a device that can provide quick and easy access to an authorized user.

The configuration of the firearm safe mount 100 also allows the firearm 50 to be stored in a half loaded configuration—meaning ammo or shotgun cartridges can be loaded into the feeding tube or magazine of the firearm 50, ready to be chambered for use. Moreover, the firearm 50 could be stored in a loaded position—meaning a cartridge is loaded into the chamber and ready to be fired; however, this configuration is not recommended for safety purposes. Additionally, the firearm safe mount 100 while in the locked position prevents another from accidently or intentionally chambering a cartridge while in a half loaded configuration.

The invention does not require that all the advantageous features and all the advantages need to be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. An apparatus for securing and locking a firearm to a wall having a receiver and trigger, comprising:

(a) a housing assembly for supporting the firearm extending therethrough, comprising:
  (i) a rear wall;
  (ii) a pair of side walls extending forward in parallel from the rear wall, the side walls each having an upper edge and at least one engagement slot, each engagement slot laterally spaced across from the other and providing passage through each respective wall; and
  (iii) a means for attaching housing assembly to a wall;

(b) a trigger and receiver guard for preventing access to the firearm trigger and receiver, the trigger and receiver guard formed as one continuous unitary piece and is freely mounted between the pair of side walls extending downward from the upper edges of the side walls, forward of the firearm trigger and receiver comprising:
  (i) an upper member positioned adjacent to the firearm receiver;
  (ii) a forward extending trigger encasement extending below the upper member positioned adjacent to the trigger and trigger guard of the firearm; and
  (iii) outwardly extending tabs positioned near the top end of the upper member, wherein the outwardly extending tabs feely overhang the opposing upper edges of the pair of side walls allowing the trigger and receiver guard assembly to hang freely therebetween inhibiting the downward travel of the trigger and receiver guard; and (c) an engagement member for pinning the trigger guard assembly and firearm within the housing assembly while in a locked position, wherein the engagement member simultaneously passes through the pair of laterally spaced engagement slots while engaging immediately forward the upper member of the trigger and receiver guard and immediately above the forward extending trigger encasement of the trigger and receiver guard, thereby pinning the trigger and receiver guard in the locked position while simultaneously urging the upper member towards the firearm receiver, entrapping the receiver of the firearm within the housing assembly.

2. The apparatus of claim 1, wherein the means for attaching housing assembly to a wall comprises a plurality of openings in the rear wall to accommodate fasteners to attach rear wall to a wall.

3. The apparatus of claim 1, wherein the forward extending encasement is U-shaped in section comprising an upward surface folded downward forming a forward surface and then folded backwards forming a downward surface.

4. The apparatus of claim 1, wherein the engagement member is generally rectangular and flat having an angled portion forming stopping tab near a first end and a locking port on an opposing end, wherein while engaged with the pair of side walls via passing through the engagement slots, the stopping tab and the locking port are positioned exterior to each respective side wall.

5. The apparatus of claim 4, further comprising a locking means adapted to cooperate with the locking port of the engagement member.

6. The apparatus of claim 4, wherein the means for attaching housing assembly to a wall comprises a plurality openings in the rear wall to accommodate fasteners to attach rear wall to a wall.

7. The apparatus of claim 6, wherein the locking means comprises a combination lock.

8. The apparatus of claim 1, wherein the housing assembly is constructed from a single sheet of heavy gauge steel.

9. An apparatus for securing and locking a firearm to a wall having a receiver and trigger comprising:

(a) a housing assembly for supporting the firearm in an upright position extending therethrough, comprising:
  (i) a rear wall;
  (ii) a pair of side walls extending forward in parallel from the rear wall, the side walls each having a top edge and at least one pair of laterally spaced engagement slots; and
  (iii) a plurality of openings in the rear wall to accommodate fasteners to attach rear wall to a wall;

(b) a trigger and receiver guard for preventing access to the firearm trigger and receiver mounted between the pair of side wall forward of the firearm trigger and receiver comprising:
  (i) an upper member positioned adjacent to the firearm receiver;
  (ii) a forward extending trigger encasement extending below the upper member positioned adjacent to the trigger and trigger guard of the firearm; and
  (iii) a means for preventing downward movement of the trigger and receiver guard assembly, comprising: outwardly extending tabs positioned near the top end of the upper member, wherein the outwardly extending tabs overhang the upper edges of the pair of side walls allowing the trigger and receiver guard assembly to hang freely therebetween inhibiting the downward movement of the trigger and receiver guard;

(c) a means for pinning the trigger guard assembly and firearm within the housing assembly while in a locked position, comprising a flat engagement member having an angled portion forming a stopping tab at a first end and a locking port at an opposing end, wherein the means for pinning simultaneously cooperates with the pair of laterally spaced engagement slots while engaging forward the upper member of the trigger and receiver guard and above the forward extending trigger encasement of the trigger and receiver guard, thereby pinning the trigger and receiver guard in position while simultaneously urging the upper member towards the firearm receiver, entrapping the receiver of the firearm within the housing assembly; and (d) a locking means adapted to cooperate with the locking port of the means for pinning.

10. The apparatus of claim 9, wherein the forward extending encasement is U-shaped in section comprising an upward surface folded downward forming a forward surface and then folded backwards forming a downward surface.

11. The apparatus of claim 10, wherein the means for pinning engages above the upward surface of the forward extending encasement.

* * * * *